US006296147B1

(12) United States Patent
Trocola et al.

(10) Patent No.: US 6,296,147 B1
(45) Date of Patent: Oct. 2, 2001

(54) DISPENSER

(75) Inventors: Gary M. Trocola, Prospect; Carl D. Contadini, Terryville; John J. Dean, Oxford, all of CT (US)

(73) Assignee: Waterbury Companies, Inc., Waterbury, CT (US)

( * ) Notice: Subject to any disclaimer, the term of this patent is extended or adjusted under 35 U.S.C. 154(b) by 0 days.

(21) Appl. No.: 09/426,985

(22) Filed: Oct. 26, 1999

(51) Int. Cl.[7] ..... B67D 5/22

(52) U.S. Cl. ..... 222/36; 222/174; 222/402.13; 222/504

(58) Field of Search ..... 222/36, 174, 402.1, 222/402.13, 402.15, 504

(56) References Cited

U.S. PATENT DOCUMENTS

| | | | | |
|---|---|---|---|---|
| 3,974,941 | * | 8/1976 | Mettler | 222/504 |
| 4,063,664 | | 12/1977 | Meetze, Jr. | 222/70 |
| 4,436,223 | * | 3/1984 | Wilson | 222/36 |
| 4,660,745 | * | 4/1987 | Hess, Jr. | 222/174 |
| 4,830,791 | | 5/1989 | Muderlak et al. | 261/26 |
| 5,038,972 | | 8/1991 | Muderlak et al. | 222/25 |
| 5,126,078 | | 6/1992 | Steiner et al. | 261/26 |
| 5,318,208 | * | 6/1994 | Van Der Wal | 222/504 |
| 5,477,993 | * | 12/1995 | Maeda | 222/402.13 |
| 5,540,359 | * | 7/1996 | Gobbel | 222/174 |
| 5,564,414 | * | 10/1996 | Walker et al. | 222/36 |
| 5,772,074 | | 6/1998 | Dial et al. | 222/1 |
| 6,036,055 | * | 3/2000 | Mogadam et al. | 222/36 |
| 6,142,339 | * | 11/2000 | Blacker et al. | 222/36 |
| 6,164,494 | * | 12/2000 | Marelli | 222/36 |

FOREIGN PATENT DOCUMENTS

| | | | | |
|---|---|---|---|---|
| 2248888 | * | 4/1992 | (GB) | 222/504 |

* cited by examiner

*Primary Examiner*—Joseph A. Kaufman
(74) *Attorney, Agent, or Firm*—Carmody & Torrance LLP

(57) ABSTRACT

A dispenser for an aerosol container is presented. The dispenser includes a housing sized to permit at least partial insertion thereinto of an aerosol container having an aerosol supply tube; and a dispenser conduit, having a proximal end and a distal end, the proximal end of the conduit being in operative connection with the housing such that the aerosol supply tube of an aerosol container inserted into the housing is operatively connected to the conduit such that it supplies the contents of the aerosol container to the conduit for dispensing through the distal end of the conduit.

8 Claims, 5 Drawing Sheets

DISPENSER

TECHNICAL FIELD

A dispenser for an aerosol container is presented. More specifically, the invention relates to a dispenser capable of facilitating the dispensing of the contents of an aerosol container, especially insecticide, pesticide and/or herbicide materials. By insecticide and/or pesticide materials is meant any materials which exhibit insecticidal and/or pesticidal activity and which can be dispensed via an aerosol container, i.e., maintained under pressure with a gaseous propellant for release as a gaseous suspension of fine solid or liquid particles.

Dispensing of insecticides and/or pesticides as aerosols is well known. One need only look in a local market or hardware store to find aerosol dispensers of insecticides or pesticides. These aerosol "cans" are generally used by pointing the spray nozzle of the can at the area to be treated (such as crevices or corners on the floor, in or around cabinets or on the ceiling), and depressing the spray head to dispense the aerosol spray. Although effective, use of the aerosol dispenser in this manner usually requires the user to repeatedly bend or stretch to bring the can in proximity to the area to be treated. Such repeated bending or stretching can be problematic, especially for a professional user, like an exterminator, who might be required to spend a great deal of time using an aerosol can and may be forced to do an inordinate amount of bending and stretching during the day, with obvious physical disadvantages to, e.g., his/her back, shoulders, etc.

In addition, in order to maximize the use of an aerosol can, that is, to dispense as much of its contents as possible in order to minimize waste, an aerosol can should be held as upright as possible, especially when almost empty. When not held upright, "pools" of the material to be dispensed can be formed within the can and not be dispensed. However, when an aerosol dispenser is being used to apply material along a floor or a ceiling, and especially to a corner of either the floor or the ceiling, it is difficult, if not impossible, to maintain the can in an upright orientation.

Moreover, local and national environmental agencies are beginning to require accounting by professional exterminators and the like of how much insecticide and/or pesticide has been dispensed, so maximum usage of those materials is not exceeded. Use of an aerosol can for dispensing, however, makes reporting requirements difficult to meet.

What is needed, therefore, is a dispenser for an aerosol container that enables the user to dispense the contents of the container while reducing the amount of bending and stretching necessitated. The dispenser should operate so as to maintain an aerosol container in an upright a position as possible and, more advantageously, enable the user to ascertain the amount of material which has been dispensed.

SUMMARY OF THE INVENTION

It is an object of the present invention to provide a dispenser for an aerosol container which permits the user to apply the contents of the container to a desired location while avoiding, or reducing, the amount of bending and stretching otherwise necessary.

It is another object of the invention to provide a dispenser for an aerosol container which is capable of maintaining the aerosol container in more of an upright position, as compared to conventional uses of the aerosol container, even when being used to apply the contents of the container to a corner of a floor or ceiling.

It is a further object of the invention to provide a dispenser for an aerosol container which can provide the user with an indication of the amount of material dispensed from the aerosol container, for reporting or other purposes.

To overcome the deficiencies of the prior art and to achieve the objects and advantages listed above, applicants disclose, in a preferred embodiment, a dispenser for an aerosol container. The inventive dispenser includes a housing sized to permit at least partial insertion thereinto of an aerosol container; and a dispenser conduit, having a proximal end and a distal end, the proximal end of the conduit being in operative connection with the housing such that the aerosol supply tube of an aerosol container inserted into the housing is operatively connected to the dispenser conduit such that it supplies the contents of the aerosol container to the dispenser conduit for dispensing through the distal end of the dispenser conduit. The dispenser preferably also includes a handle portion, the handle portion at least partially forming the connection between the housing and the dispenser conduit. As such, the handle portion should have a connection conduit, which operatively connects the aerosol supply tube of an aerosol container with the dispenser conduit.

The inventive dispenser also preferably includes an assembly for controlling the dispensing of the contents of an aerosol container, preferably a solenoid/valve assembly in operative connection with the dispenser conduit, most preferably located towards the distal end of the dispenser conduit. In use, when an aerosol container is inserted in the housing, the contents of the aerosol container can be maintained under pressure through the dispenser conduit to the solenoid/valve assembly in order to facilitate dispensing of the contents of the aerosol container. A trigger which actuates the solenoid/valve assembly, causing dispensing of the contents of the aerosol container through the distal end of the dispenser conduit, is advantageously also included.

In use, the solenoid/valve assembly can be powered by one or more batteries, and electrical contact between the one or more batteries and the solenoid/valve assembly can be maintained via an outer conduit disposed about the dispenser conduit and the dispenser conduit itself, each conduit acting to provide a conductive pathway.

In order to maintain the aerosol container in position in the housing, the inventive dispenser can also include a fitting disposed within the housing and having a plurality of angular elements each of which define a shape generally complementary to the shape of either an inner or an outer portion of the surface of the collar of an aerosol container, the elements cooperatively forming a shape such that i. when the plurality of angular elements define a shape complementary to an inner portion of the surface of the collar, the plurality of angular elements each have a forward portion collectively defining a shape having a diameter greater than the minimum diameter of the collar and a concave portion having a diameter approximately equal to or slightly less than the minimum diameter of the collar; and ii. when the plurality of angular elements define a shape complementary to an outer portion of the surface of the collar, the plurality of angular elements each have a forward portion collectively defining a shape having a diameter less than the maximum diameter of the collar and a concave portion having a diameter approximately equal to or slightly greater than the maximum diameter of the collar, wherein one or more of the plurality of angular elements is capable of flexing such that the fitting can be applied over the collar and thereby hold the aerosol container by the collar.

Moreover, the fitting can be rotatably disposed within the housing, such as by being suspended on pins journaled into either the fitting, the housing, or both, to provide rotatability, and to thus maintain an aerosol container held by the fitting (and, therefore, the inventive dispenser) in as upright a position as possible.

Further, the dispenser also has a system for indicating the status of at least one characteristic of the dispenser, such as indicating the amount of material dispensed or the dispensing of a predetermined amount of the material to be dispensed.

The present invention is applicable to a variety of dispensers capable of dispensing a material, such as an olfactory stimulating material. By "olfactory stimulating material" is meant any material that affects the olfactory response to the environment of a room or like space. Such material, when dispensed in an area, performs the functions of air freshening and/or deodorizing and/or otherwise improves the smell or quality of the air in the area into which the material is dispensed. Most preferably, however, the dispenser is one capable of dispensing a pesticide (that is, any chemical that is used to kill pests, especially insects and rodents), an insecticide (an agent used to kill insects), a bactericide (i.e., a composition capable of killing airborne bacteria), or a herbicide (a substance used to destroy plants, especially weeds, and most especially outdoors). Of course, the skilled artisan will recognize still other materials that can be dispensed by an aerosol container using the dispenser of the present invention.

The inventive dispenser includes a housing into which an aerosol container (i.e., a can) can be inserted. The housing can be one in which the can can be completely inserted thereinto, with the housing closed about it; more preferably, the housing is one which at least partially encloses the can. For instance, only the top portion of the aerosol can need be inserted into the housing, to ensure that a proper connection is made to permit dispensing of the contents of the can.

The housing can be made of any suitable material, such as a plastic, like an acrylonitrile-butadiene-styrene copolymer (ABS), low- or high-density polyethylene, polypropylene or medium impact styrene, and can be made by any suitable method, such as by injection molding. The size and shape of the housing are not critical, provided it is capable of functioning as described below.

The aerosol can which is the source of material to be dispensed for the inventive dispenser is one having an aerosol supply tube. That is, the can has a tube that functions as the "dispenser" for material in the can. The aerosol supply tube can be located by, for instance, removing the spray head commonly found on aerosol containers and which is depressed in order to actuate the container and dispense the material contained in the aerosol can. Contrariwise, the aerosol can to be used as the source of material to be dispensed for the subject dispenser can be provided without a spray head, and with the aerosol supply tube exposed. Actuation of the aerosol supply tube (by, for instance, downward pressure on it) causes the material maintained under pressure in the can to be dispensed out the supply tube.

The inventive dispenser also includes a dispenser conduit, which is in operative connection with the housing and, through the housing, with the aerosol supply tube of the aerosol can. The dispenser conduit has a proximal end, which is the end in operative connection with the housing, and a distal end, through which the contents of the aerosol can are dispensed to the area to be treated. The dispenser conduit can be any conduit sufficient to permit flow therethrough of the material to be dispensed, and is made of a material resistant to interaction with the contents of the aerosol container. Although the dispenser conduit can be flexible, it is preferably rigid in nature, to facilitate its use. Suitable materials for use include plastics, rubber materials and metals, or metallized plastics or rubbers, provided the appropriate dimensional stability and resistance are present. Most commonly, the dispenser conduit is made of steel.

The dispenser conduit should be of such length as to reduce the amount of bending and stretching required of the user. For instance, with respect to use of the inventive dispenser to dispense the contents of an aerosol container on the floor, the dispenser conduit should most preferably be of sufficient length that the user can target dispensing of the contents to the desired area while bending less than would be required by simply using the aerosol can itself. Similar logic applies for dispensing at or near the ceiling, or outdoors on the ground or around structures. Indeed, the inventive dispenser can be provided with a set of dispenser conduits of different lengths depending on the user's requirements or the application. Typically, a dispenser conduit of from about 6 inches to about 24 inches is sufficient, more typically about 12 inches to about 18 inches. In addition, the dispenser conduit can be slightly bent at or near its distal end to facilitate ease of use and targeting with reduced bending or stretching.

Although the dispenser conduit can extend directly from the body of the housing, in a preferred embodiment, the housing has a handle portion from which the dispenser conduit extends. The handle portion forms the connection between the housing and the dispenser conduit, such that material from an aerosol container disposed in the housing flows through the handle portion, more specifically through a connection conduit extending through the handle portion, to the dispenser conduit. The dispenser conduit extends from the handle portion in a direction generally horizontal when the housing and aerosol can are oriented in a generally vertical direction, thus insuring that the aerosol can is maintained in a generally upright orientation when in use, as is desired.

The handle portion can be formed of any suitable material, such as a plastic, like an acrylonitrile-butadiene-styrene copolymer (ABS), low- or high-density polyethylene, polypropylene or medium impact styrene, and can be made by any suitable method, such as by injection molding. Although it is not necessary that the handle portion be made of the same material as the housing, such is preferred for ease of manufacture. Indeed, the handle portion can be formed integral with the housing.

Although the handle portion can simply comprise a hollow tube-like structure, it more preferably is configured as a grip to facilitate handling of the inventive dispenser. Additionally, the handle portion can also include a trigger that functions to actuate dispensing of the contents of the aerosol container from the distal end of the dispenser conduit (of course, the trigger can also be located at a different location on the inventive dispenser, but the handle portion is the most convenient location). The trigger can be any suitable mechanical or electrical trigger mechanism, provided it is functions to control dispensing of the material to be dispensed.

As noted, the inventive dispenser also includes a mechanism for controlling the dispensing of the contents of the aerosol can. It is this mechanism, in fact, which is triggered by the trigged noted above. The dispensing mechanism can comprise a valve or other like mechanical arrangement, but most advantageously uses a solenoid/valve arrangement as described above.

In this type arrangement, the solenoid is arrayed over the aerosol supply tube with a valve in operational contact with the solenoid, such that constant aerosol pressure is maintained from the aerosol container, through the aerosol supply tube and to (indeed, through) the solenoid/valve assembly. Actuation of the solenoid causes the valve to open and the contents of the aerosol can to be dispensed through the distal end of the dispenser conduit.

Most preferably, the solenoid/valve assembly is located along the dispenser conduit, at or near its distal end. In this manner, constant aerosol pressure is maintained through the dispenser conduit to the solenoid/valve assembly such that actuation of the solenoid/valve assembly causes dispensing without the delay which would otherwise be encountered if the flow had to proceed the length of the dispenser conduit after actuation before dispensing out its distal end began. Advantageously, the solenoid/valve assembly can have a nozzle or other like apparatus located downstream of it, to direct or otherwise control the dispensing stream.

In a most preferred embodiment of the inventive dispenser, the dispenser includes an outer conduit disposed about the dispenser conduit. This outer conduit can be formed of plastics, rubber materials and metals, or metallized plastics or rubbers, and is most preferably a metal like steel. The outer conduit is commonly, but not necessarily, co-axial with the dispenser conduit and can include spacers and the like to maintain the relative axial positions of the outer conduit and the dispenser conduit. The principal purpose of the outer conduit is as protection for the dispenser conduit. This is especially important since the dispenser conduit can have a relatively narrow inner diameter, on the order of about 1/32 inch to about 1/4 inch, more preferably about 1/16 inch to about 1/8 inch, in order to maintain adequate pressure of the contents of the aerosol container as they are flowing therethrough, and as such can be fragile and subject to damage during normal handling and use. The diameter of the connection conduit is of the same order (as is the aerosol supply tube), but is protected by the handle portion. The outer conduit can be of any desired inner and outer diameter, provided it is sufficient to surround and protect the dispenser conduit; typically, the outer conduit is about 1/2 inch to about 5/8 inch in outer diameter, more preferably about 3/8 inch to about 1/2 inch.

Power for the dispenser, such as for the solenoid/valve assembly and/or the trigger, can be provided by one or more batteries. Although the connection between the batteries, the trigger and the solenoid/valve assembly can be by conventional electrical connections, such as wires and the like, where the outer conduit and the dispenser conduit are metallic or a metallized material, the conduits themselves can function, at least in part, as the electrical connections between the batteries and the trigger, and the solenoid/valve assembly, in order to avoid the manufacturing and other drawbacks of running wires along the dispenser conduit to the solenoid/valve assembly.

In still another advantageous embodiment of the present invention, the housing comprises a fitting that can act in cooperation with the collar of the aerosol container to maintain the source in position in the housing. The fitting is disposed within the housing and has a plurality of angular elements. Each of the elements of the fitting cooperate to define a shape generally complementary to the shape of either an inner or an outer portion of the surface of the collar. In this manner, when the plurality of angular elements define a shape complementary to an inner portion of the surface of the collar, the plurality of angular elements each have a forward portion collectively defining a shape having a diameter greater than the minimum diameter of the collar and a concave portion having a diameter approximately equal to or slightly less than the minimum diameter of the collar. Similarly, when the plurality of angular elements define a shape complementary to an outer portion of the surface of the collar, the plurality of angular elements each have a forward portion collectively defining a shape having a diameter less than the maximum diameter of the collar and a concave portion having a diameter approximately equal to or slightly greater than the maximum diameter of the collar. Moreover, one or more of the plurality of angular elements is capable of flexing such that the fitting can be applied over the collar and thereby hold the aerosol container by the collar. In other words, the fitting "snaps" over the collar, with the elements cooperating to removably attach the collar, and thus the aerosol can, to the fitting.

Most advantageously, the fitting is rotatably disposed within the housing, to such that the aerosol container "floats" with respect to its vertical orientation when in use. In this manner, when the user changes the vertical orientation of the dispenser, as would be expected during use, the can stays in a relatively vertical position to as great an extent as possible. This can be accomplished by, for instance, suspending the fitting on pins journaled into either the fitting, the housing, or both, to provide the desired rotatability.

In yet another advantageous embodiment of the invention, the dispenser also comprises a system that provides an indication of the status of at least one characteristic of the dispenser. For instance, the aerosol can is finite in capacity. This being the case, it needs to be replaced with a fresh or full can after a certain period of operation of the dispenser. Thus, the system can provide an indication of when the container needs to be replaced, and/or the remaining life (such as in days) of the container. Also, many jurisdictions require reporting of the usage of certain chemicals, like some pesticides for instance. This is especially true for professionals such as exterminators. The system can thus provide an indication of the amount of material dispensed. In addition, remaining battery life, or the need to replace exhausted batteries, can also be indicated.

For example, if the dispenser is dispensing for x minutes, the amount of material dispensed can be calculated based on the rate of dispensing (known from the pressure in the aerosol container and the diameters of the conduits, nozzles, etc.). The system can record the dispensing time and then factor in the rate of dispensing to provide an indication of the amount of material dispensed. This can be done by way of a computer chip or circuit, which would be known to the skilled artisan. The result can be displayed on, e.g., a liquid crystal display (LCD) or the like.

These and other objects will become more readily apparent when the following description is read in conjunction with the accompanying drawings.

DETAILED DESCRIPTION OF THE DRAWINGS

Figures 1, 2:
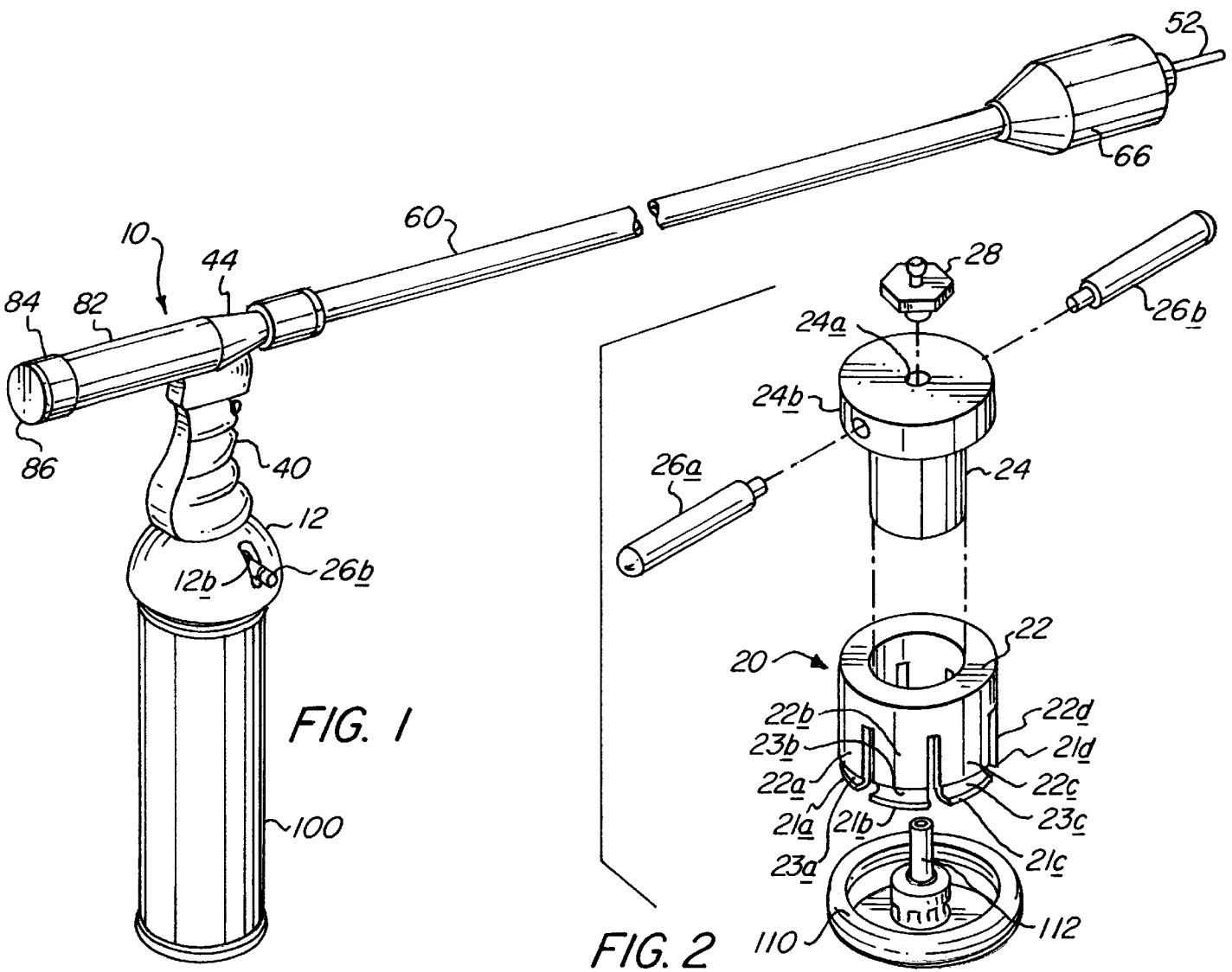
FIG. 1 is a perspective view of one embodiment of the dispenser of the present invention, having an aerosol container inserted therein.
FIG. 2 is a partially exploded perspective view of a fitting used in the dispenser of FIG. 1 to maintain an aerosol container in position.

Referring to FIG. 1, a dispenser, constructed in accordance with the present invention, is shown and generally designated by the reference numerals 10. It should be noted that, for the sake of clarity, all the components and parts of dispenser 10 may not be shown and/or marked in all the drawings. Also, as used in this description, the terms "up", "down", "front", "back", "top", "bottom", etc. refer to dispenser 10 when in the orientation illustrated in FIG. 1. It will be understood, however, that dispenser 10 may be in any of various orientations when in use, and, as such, the orientation illustrated in FIG. 1 is not necessary for operability.

Although this description is written in terms of dispensing a pesticide and/or an insecticide, such description is for convenience only. It should be understood that the present invention applies to a dispenser for any material capable of being dispensed by an aerosol container, especially a liquid such as an olfactory stimulating material, antistatic agent, bactericide, etc. Such materials are generally liquid in active form, i.e., when applied to a desired area or when vaporized in the environment to provide the desired effects.

Figures 3, 4:
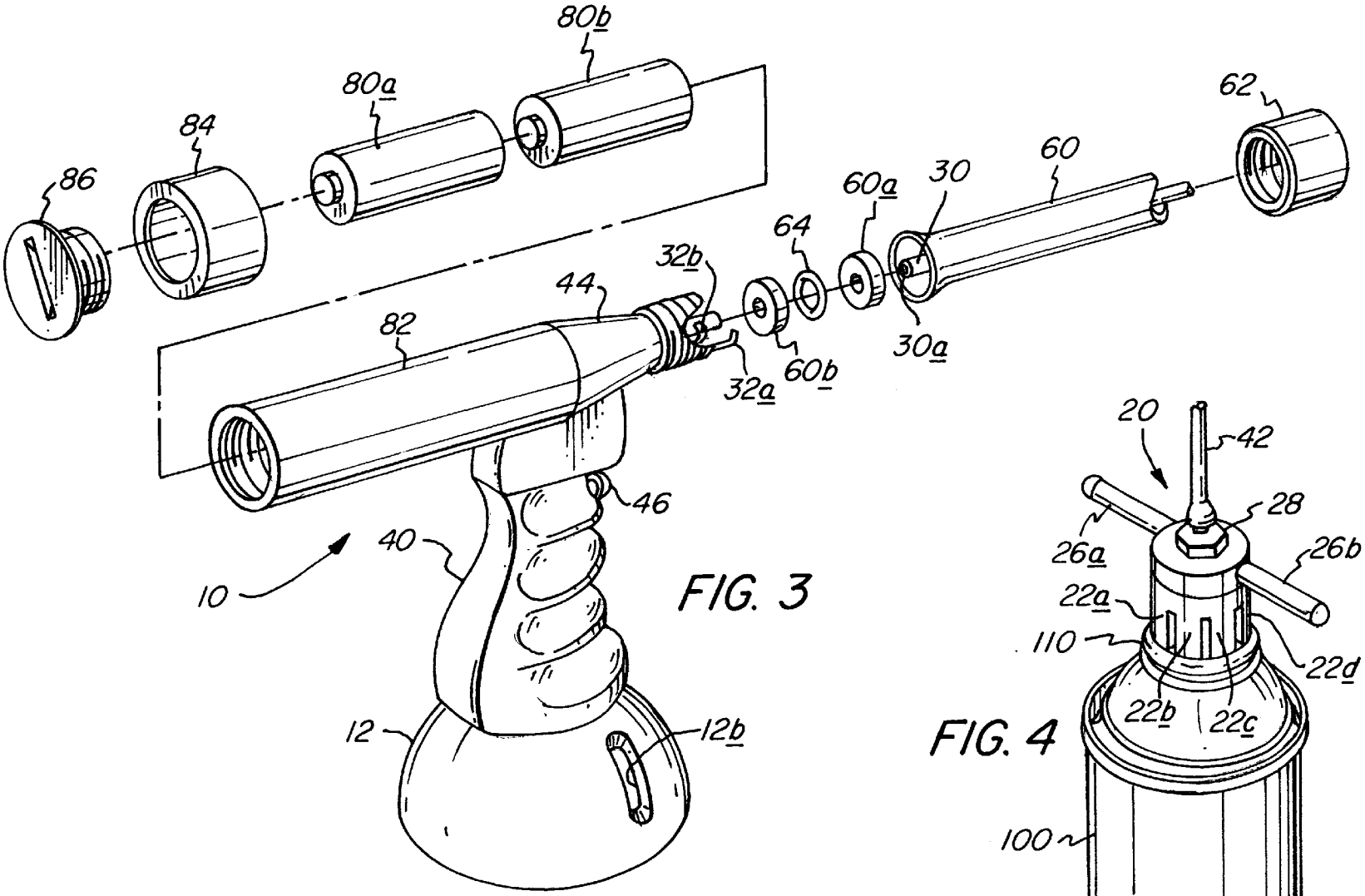
FIG. 3 is a partially exploded perspective view of a portion of the dispenser of FIG. 1.
FIG. 4 is a perspective view of the fitting of FIG. 2, having an aerosol container maintained thereby.
Figure 8:
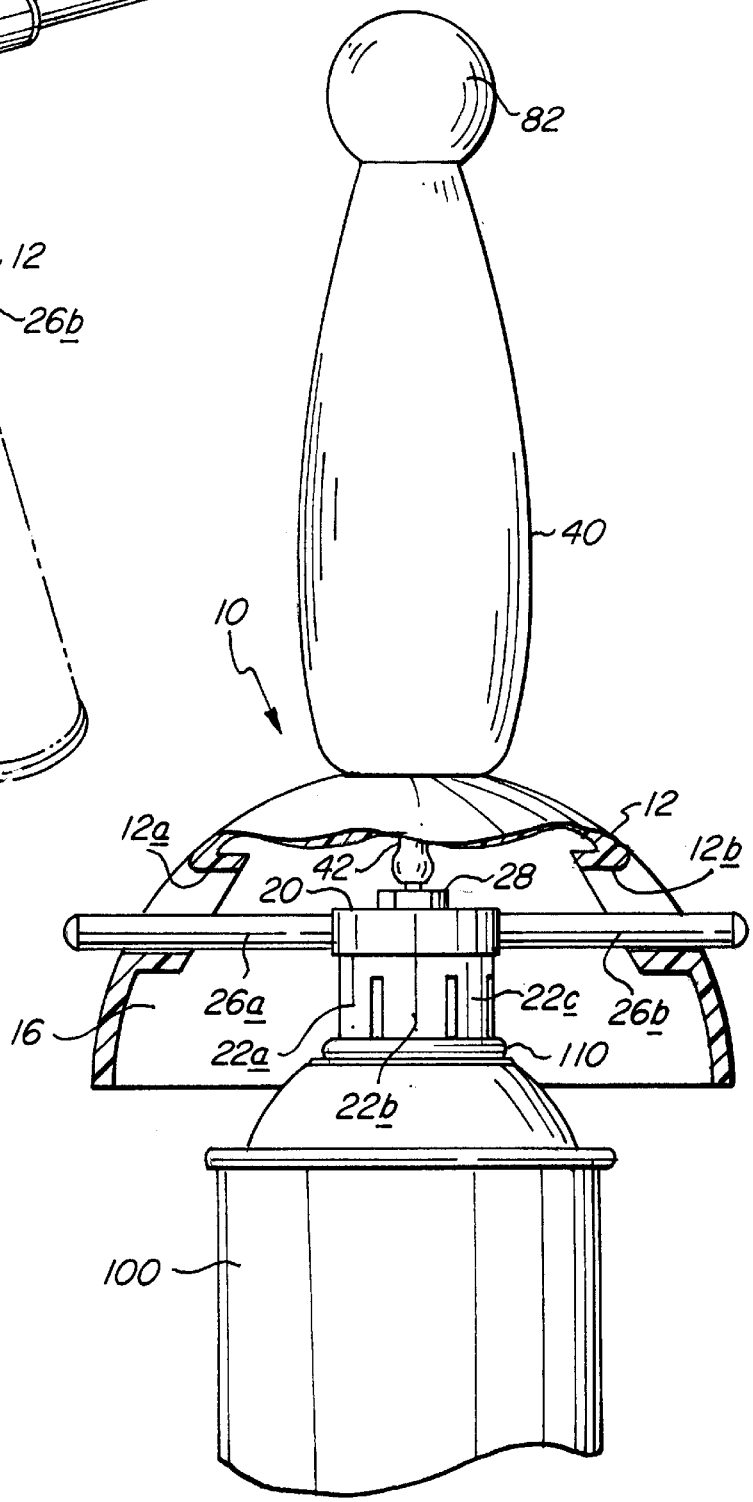
FIG. 8 is a partially broken-away rear plan view of the dispenser of FIG. 1, having an aerosol container inserted therein.

Referring now to FIGS. 1, 3 and 8, dispenser 10 generally comprises a housing 12. Housing 12 can be made of any suitable material, such as a plastic, like an acrylonitrile-butadiene-styrene copolymer (ABS), low- or high-density polyethylene, polypropylene or medium impact styrene, and can be made by any suitable method, such as by injection molding. The size and shape of housing 12 is not critical, provided it is capable of functioning as described below. Housing 12 includes an internal cavity 16 sized to permit insertion of an aerosol container 100 into cavity 16, as shown in FIGS. 1, 8 and 9.

Referring now to FIGS. 2 and 4, in an advantageous embodiment of the present invention, housing 12 comprises a fitting 20 which can act in cooperation with the collar 110 of aerosol container 100 to maintain aerosol container 100 in position in housing 12. Fitting 20 is disposed within housing 12 and includes a base 22 having a plurality of angular elements 22*a*, 22*b*, 22*c*, 22*d*, etc. Each of elements 22*a*, 22*b*, 22*c*, 22*d*, etc. of fitting 20 cooperate to define a shape generally complementary to the shape of either an inner or an outer portion of the surface of the collar 110 (usually, collar 110 is circular in shape, as illustrated in FIG. 2). In this manner, when the plurality of angular elements 22*a*, 22*b*, 22*c*, 22*d*, etc. define a shape complementary to an inner portion of the surface of the collar 110, the plurality of angular elements 22*a*, 22*b*, 22*c*, 22*d*, etc. each have a forward portion 21*a*, 21*b*, 21*c*, 21*d*, etc. collectively defining a shape having a diameter greater than the minimum diameter of the collar 110 and a concave portion 23*a*, 23*b*, 23*c*, 23*d*, etc. having a diameter approximately equal to or slightly less than the minimum diameter of the collar 110. In use, fitting 20 "snaps" over collar 110, as illustrated in FIGS. 2, 4 and 10, with the elements 22*a*, 22*b*, 22*c*, 22*d*, etc. cooperating to removably attach the collar 110, and thus aerosol container 100, to fitting 20 and thus to housing 12.

Figure 9:
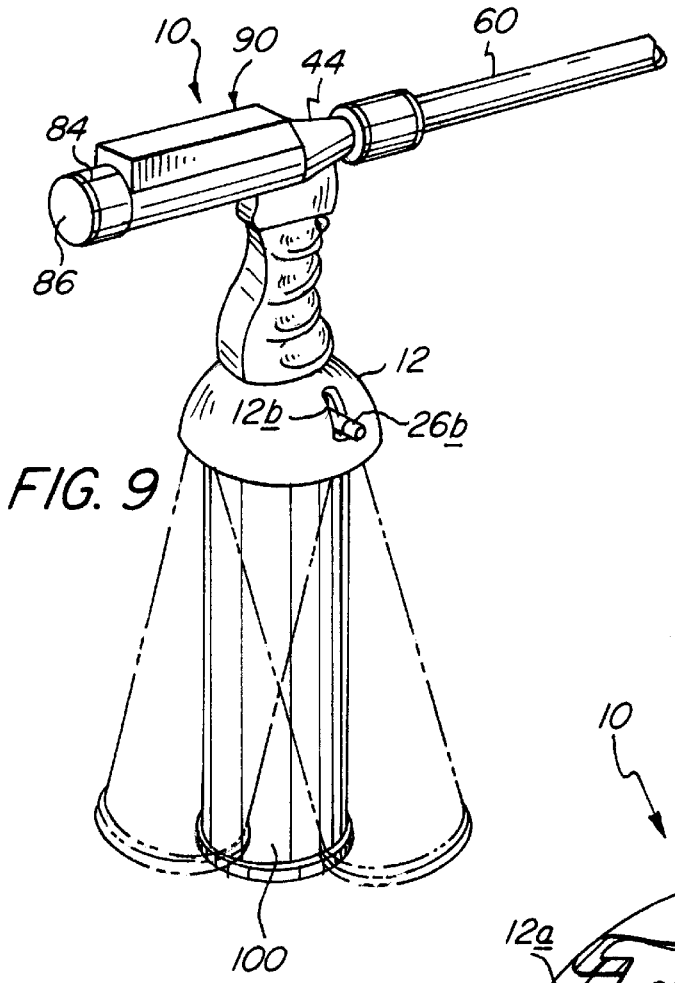
FIG. 9 is a partial perspective view of the dispenser of FIG. 1, having an aerosol container inserted therein and illustrating the "floating" of the aerosol container.

Most advantageously, and as seen in FIGS. 8 and 9, fitting 20 is rotatably disposed within housing 12, to permit aerosol container 100 to "float" with respect to its vertical orientation, to maintain an upright orientation to as great an extent as possible in use, when the orientation of dispenser 10 is changed by the user. This can be accomplished by suspending fitting 20 on pins 26*a*, 26*b* journaled into either fitting 20, housing 12 (i.e., through slots 12*a* and 12*b*), or both, to provide the desired rotatability.

Fitting 20 further comprises insert 24, as can be seen in FIGS. 2, 4 and 8. Insert 24 has an internal conduit 24*a*, which permits flow of the contents of aerosol container 100 from aerosol supply tube 112 into housing 12 and dispenser 10. Moreover, insert 24 also includes port 24*b*, into which pin 26*a* can be journaled or otherwise located (insert 24 also includes a second port, not shown, into which pin 26*b* can be journaled or otherwise located). Insert 24 should be fit into base 22, or otherwise affixed to base 22, to avoid separation.

Figure 5:
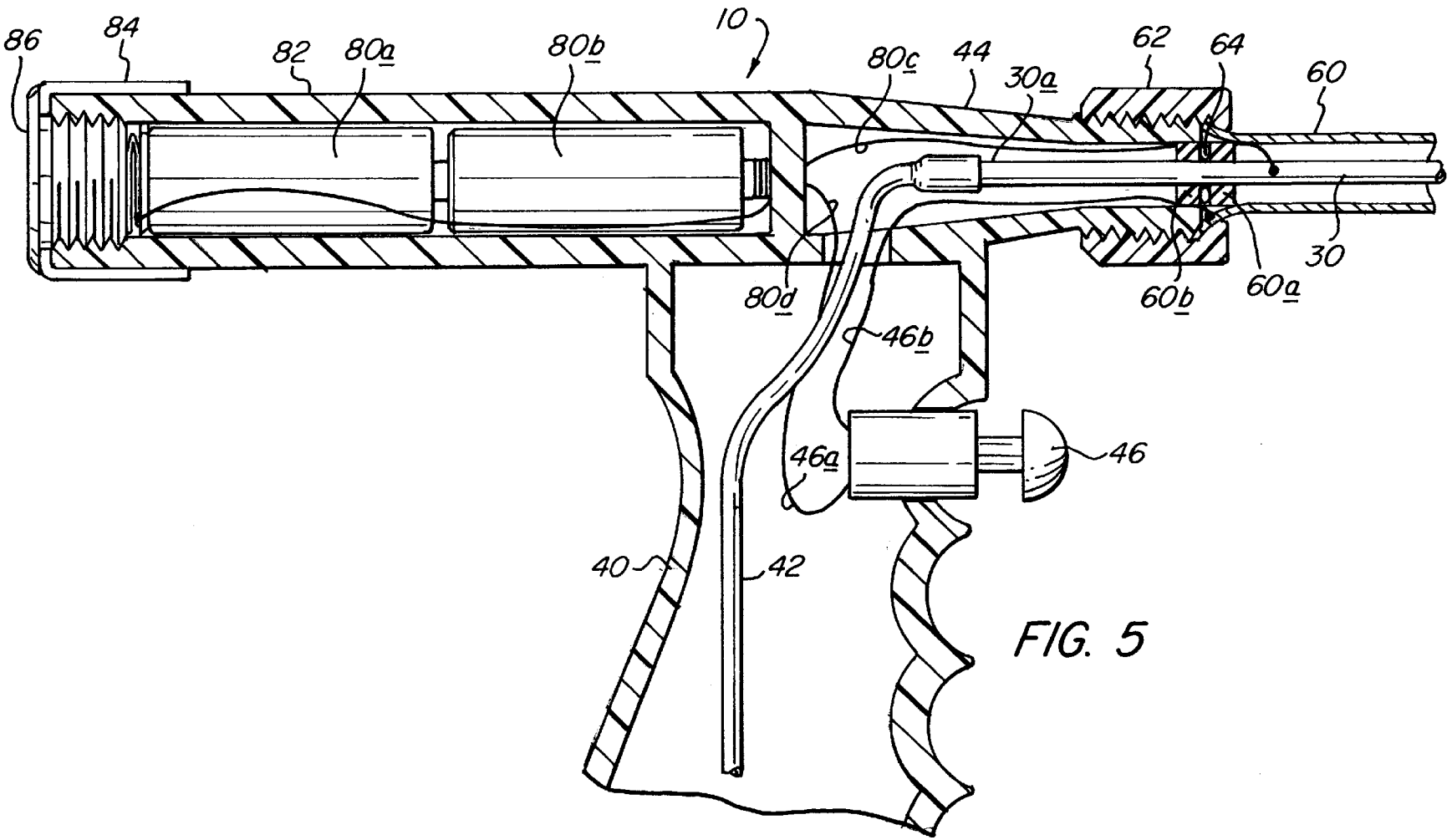
FIG. 5 is a cross sectional side plan view of a portion of the dispenser of FIG. 1.
Figure 6:
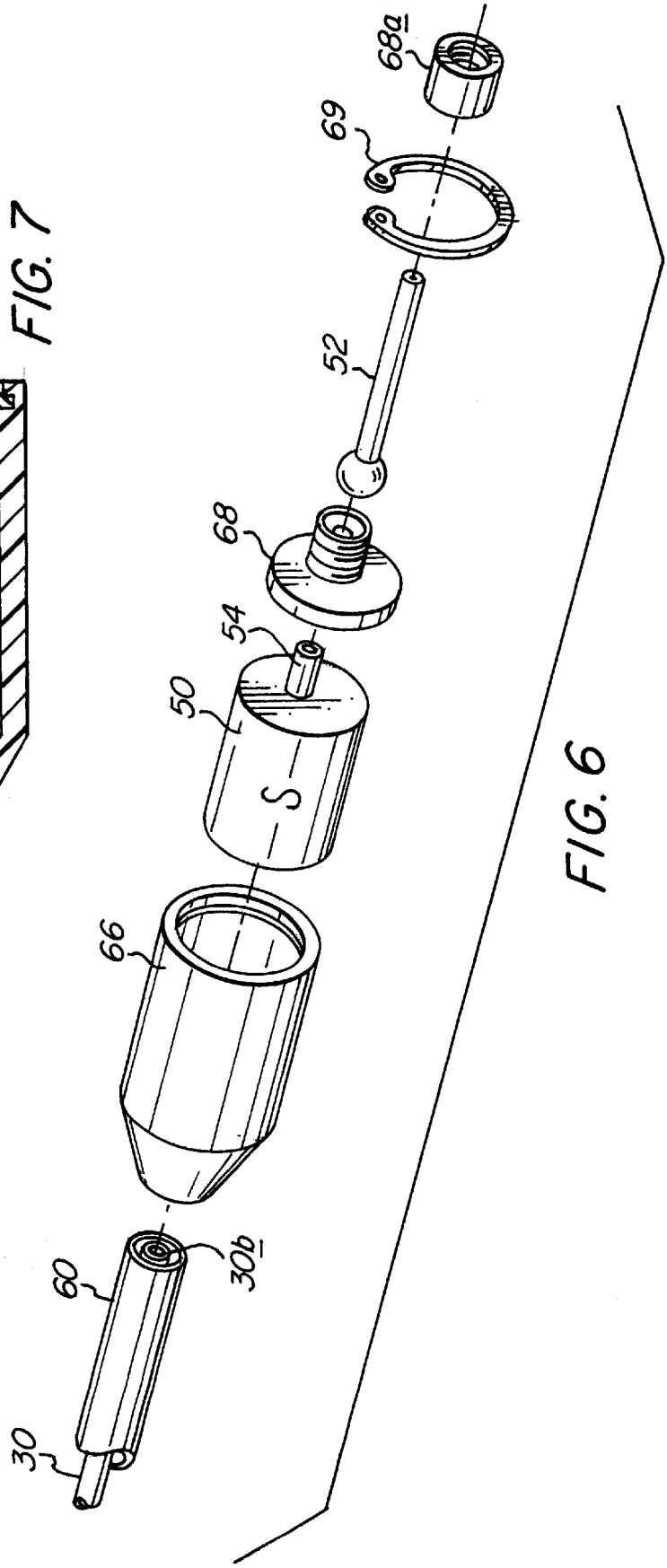
FIG. 6 is an exploded perspective view of the distal end of the dispenser of FIG. 1.

Referring now to FIGS. 3, 5 and 6, dispenser 10 also includes a dispenser conduit 30, which is in operative connection with housing 12 and, through housing 12, with aerosol supply tube 112 of aerosol container 100. Dispenser conduit 30 has a proximal end 30*a*, which is the end in operative connection with housing 12, and a distal end 30*b*, through which the contents of aerosol 100 can are dispensed.

As illustrated in FIGS. 3 and 5, dispenser 10 also includes a handle portion 40, which forms the connection between housing 12 and dispenser conduit 30, especially proximal end 30*a* of dispenser conduit 30, such that the contents of aerosol container 100 flow through handle portion 40. To this end, handle portion 40 includes a connection conduit 42 extending through handle portion 40, to dispenser conduit 30. Connection conduit 42 is connected to nipple 28 of fitting 20 (as seen in FIG. 4) to permit flow of the contents of aerosol container 100 from aerosol supply tube 112 through insert 24 and nipple 28 of fitting 20 and into connection conduit 42. As illustrated in FIG. 5, connection conduit 42 also connects to dispenser conduit 30 at its proximal end 30*a*, to permit the contents of aerosol container 100 to flow from connection conduit 42 to dispenser conduit 30. Handle extension 44 (which is either attached to or integral with handle portion 40) is provided within which the connection between connection conduit 42 and dispenser conduit 30 is made.

Handle portion 40 is preferably configured as a grip to facilitate handling of the inventive dispenser, as can be seen in FIGS. 1, 3 and 5. Moreover, handle portion 40 can also include a trigger 46 that functions to actuate dispensing of the contents of aerosol container 100 from distal end 30*a* of dispenser conduit 30.

Figure 7:
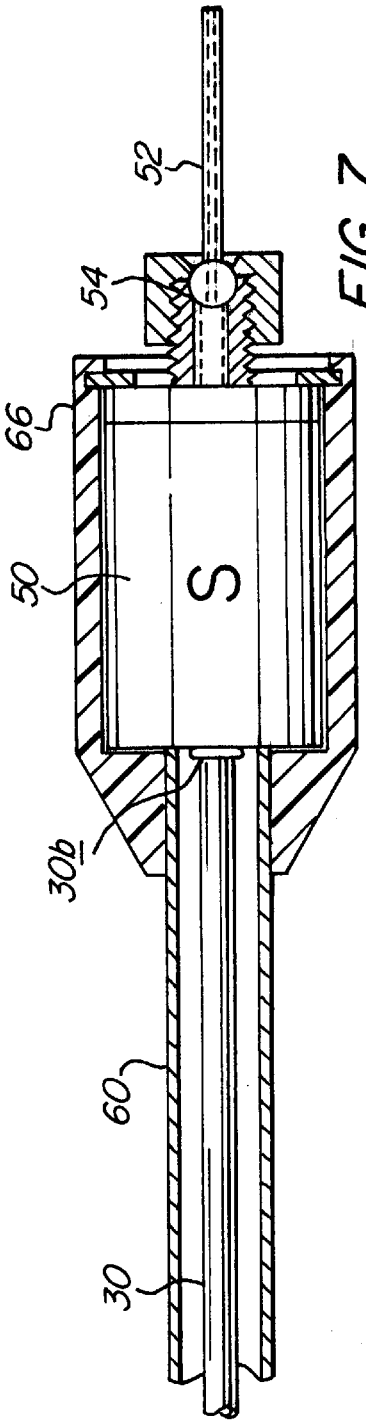
FIG. 7 is a cross sectional side plan view of the distal end of the dispenser of FIG. 1.

Referring now to FIGS. 6 and 7, dispenser 10 can comprise a solenoid "S" in combination with a valve (denoted solenoid/valve assembly 50) in order to control the dispensing of the contents of aerosol container 100 by dispenser 10. When aerosol container 100 is inserted in housing 12, constant aerosol pressure is maintained from aerosol container 100, through the aerosol supply tube 112, through nipple 28, connection conduit 42, dispenser conduit 30 and to (indeed, through) solenoid/valve assembly 50. Actuation of the solenoid causes the valve to open and the contents of the aerosol can to be dispensed through solenoid/valve assembly 50.

Most preferably, solenoid/valve assembly 50 is located at or near distal end 30*b* of dispenser conduit 30. Advantageously, solenoid/valve assembly 50 has a nozzle 52 or other like apparatus located downstream of it, to direct or otherwise control the dispensing stream.

Advantageously, dispenser 10 includes an outer conduit 60 disposed about dispenser conduit 30. Outer conduit 60 is preferably co-axial with dispenser conduit 30 and can include spacers such as 60*a*, 60*b* and the like to maintain the relative axial positions of outer conduit 60 and dispenser conduit 30. The principal purpose of outer conduit 60 is as protection for dispenser conduit 30, but outer conduit 60 and dispenser conduit 30 can, in a most preferred embodiment function as the electrical connections between the batteries 80*a* and 80*b* used to power dispenser 10 (and found in battery compartment 82, attached to and/or integral with, handle portion 40 and handle extension 44) and trigger 46, and solenoid/valve assembly 50, in order to avoid the manufacturing and other drawbacks of running wires along dispenser conduit 30 to solenoid/valve assembly 50. Of course, some wires, 46*a*, 46*b*, 80*c*, 80*d* and other contacts 32*a*, 32*b*, may still be necessary to make the required electrical connection among and between batteries 80*a*, 80*b*, trigger 46 and outer conduit 60 and inner conduit 30 to power solenoid/valve assembly 50, as seen in FIGS. 3 and 5.

Referring now to FIG. 9, dispenser 10, in a preferred embodiment, further includes a system 90 for determining and indicating the dispensing of a certain amount of the contents of aerosol container 100. System 90 includes the appropriate electronics capable of detecting dispensing and calculating the amount of material dispensed, and displaying or otherwise storing for later display, the results.

As illustrated in FIGS. 3 and 5, assembly of outer conduit 60 and dispenser conduit 30 to handle portion 40 (more specifically handle extension 44) by the use of compression fitting 62 or other like means which can be attached (i.e., screwed onto) to a threaded portion of handle extension 44, locking outer conduit 60 to handle extension 44 as shown. Spacers 60*a*, 60*b*, as well as an O-ring 64. Batteries 80*a*, 80*b* are maintained in position in battery compartment 82 via fitting 84 and battery compartment cover 86. Similarly, and as shown in FIGS. 6 and 7, solenoid/valve assembly 50 is mounted onto distal end 30*b* of dispenser conduit 30 via distal fitting 66 which fits about outer conduit 60, with distal end 30*b* of dispenser conduit 30 extending into solenoid conduit 54, which passes through solenoid/valve assembly 50 and enables solenoid/valve assembly 50 to control dispensing of the contents of aerosol container 100. Distal fitting 66 is maintained in position, thus maintaining solenoid/valve assembly 50 in position, by compression bolt 68 which cooperates with flange 69 and nut 68*a*. Nozzle 52 sits in flange 69 so as to be capable of being directed in various directions.

It should be understood by those skilled in the art that obvious modifications can be made to the present invention without departing from the spirit of the invention. Accordingly, reference should be made primarily to the accompanying claims, rather than the foregoing specification, to determine the scope of the invention.

What is claimed is:

1. A dispenser assembly for dispensing the contents of an aerosol container, the dispenser assembly comprising:

a fitting coupleable to the aerosol container;

a dispenser conduit having a proximal end operatively coupled to the aerosol container and a distal end out through which the contents of the aerosol container exits; and an outer conduit disposed about dispenser conduit, wherein the outer conduit in combination with the dispenser conduit can change the direction of the dispensing of the contents of the aerosol container from a vertical direction relative to the aerosol container to at least a direction orthogonal thereto; and a solenoid/valve assembly disposed in coaxial alignment with the outer conduit and the dispenser conduit;

wherein the solenoid/valve assembly is located closer to the distal end of the dispenser conduit than the proximal end of the dispenser conduit.

2. The dispenser assembly as claimed in claim 1, wherein the dispenser conduit is at least 6 inches long and the solenoid/valve assembly is located closer to the distal end of the dispenser conduit than the proximal end thereof.

3. The dispenser assembly as claimed in claim 1, wherein the dispenser conduit is at least 12 inches long and the solenoid/valve assembly is located closer to the distal end of the dispenser conduit than the proximal end thereof.

4. A dispenser assembly for dispensing the contents of an aerosol container, the dispenser assembly comprising:

a fitting coupleable to the aerosol container;

at least one pin in cooperative engagement with and extending from the fitting;

a dispenser unit comprising (i) a base coupled to the at least one pin such that the dispenser unit is pivotable relative to the aerosol container when the fitting is coupled to the aerosol container and (ii) a distal end out through which the contents of the aerosol container exits; and a conduit for providing a passage for the contents of the aerosol container from the aerosol container through the dispenser unit to the distal end of the dispenser unit and out thereof.

5. The dispenser assembly as claimed in claim 4, comprising a housing coupleable to the base of the dispensing unit and pivotably engageable with the at least one pin.

6. The dispensing unit as claimed in claim 5, wherein the at least one pin extends through the housing to facilitate the pivotability of the dispensing unit relative to the aerosol container.

7. The dispenser assembly as claimed in claim 5, wherein the at least one pin is an elongated pin that extends, at each end, outwardly from the fitting;

wherein a first and second slot is provided in the housing, the slots being dimensioned to respectively receive the ends of the pin therethrough.

8. The dispenser assembly as claimed in claim 5, including a first and a second pin, both of which extend outwardly from the fitting;

wherein a first and second slot is provided in the housing, the first and second slot being dimensioned to respectively receive the first and second pins therethrough.

* * * * *